US006140596A

United States Patent [19]

Tsay

[11] Patent Number: 6,140,596

[45] Date of Patent: Oct. 31, 2000

[54] TACT SWITCH

[75] Inventor: Chin-Shan Tsay, Hsin-Tien, Taiwan

[73] Assignee: Shin Jiuh Corporation, Hsin-Tien, Taiwan

[21] Appl. No.: 09/477,373

[22] Filed: Jan. 4, 2000

[51] Int. Cl.[7] ..... H01H 5/18

[52] U.S. Cl. ..... 200/406; 200/5 A

[58] Field of Search ..... 200/406, 5 A, 200/1 B, 159 B, 159 A

[56] References Cited

U.S. PATENT DOCUMENTS

| | | | |
|---|---|---|---|
| 4,146,767 | 3/1979 | Murata | 200/159 B |
| 4,385,218 | 5/1983 | Nishida | 200/159 B |
| 4,412,113 | 10/1983 | Mitsugi et al. | 200/67 DB |
| 4,778,952 | 10/1988 | Watkins et al. | 200/5 A |
| 4,803,321 | 2/1989 | Lefebvre | 200/517 |
| 5,079,394 | 1/1992 | Torma et al. | 200/407 |
| 5,898,147 | 4/1999 | Domzalski et al. | 200/1 B |

*Primary Examiner*—Michael L. Gellner
*Assistant Examiner*—Nhung Nguyen
*Attorney, Agent, or Firm*—Bacon & Thomas, PLLC

[57] ABSTRACT

An improved structure of tact switch comprises a seat body, a first elastic element, a press set, and a closure body. After assembling and jointing the first elastic element and the press set in the seat body, the assembly procedure is to couple the closure body onto the seat body. When the press set is pressed down by an external force, it will in turn press the first elastic element downwards to make connection between a first conductive electrode and a pair of second conductive electrodes.

3 Claims, 4 Drawing Sheets

TACT SWITCH

BACKGROUND OF THE INVENTION

This invention relates to an improved structure of tact switch, particularly to a tact switch that can prolong lifetime of its inside components.

A so-called tact switch widely applied in computer, remote controller, mouse, light pen, etc is formed by disposing a reed dome then a pushbutton, from the bottom to the top, on a seat body with an open face, wherein the seat body is covered peripherally by a closure for keeping each inside element in place so that the reed dome will be pressed to contact an electrode thereunder and release an output signal when the pushbutton is pressed.

The tact switch purchasable locally so far may be grouped into three categories according to the material adopted: a first one containing a rubber pushbutton and a Be-Cu or Pb-Cu reed dome; a second containing a plastic pushbutton and a reed dome as above; and a third containing a plastic pushbutton as above and a more expensive high quality reed dome.

When the first tact switch is pressed, the pushbutton will contact the reed dome softly that ensures a longer lifetime with an average press-durability of one million times. However, after a long duration, the rubber pushbutton will become hardened and is liable to get impaired, and in addition, it may reflect a damp and acerb feeling when being touched.

The plastic pushbutton of the second can keep its own surface tidier and more flush than that of the rubber in a long duration, however, as the bottom thereof touches the reed dome directly, the latter will inevitably wear away gradually with an average press-durability of one hundred thousand times—about one tenth of the rubber made.

The third is a combination of a plastic pushbutton and a more expensive high quality reed dome with a press-durability about the same as the first.

In view of the forgoing respective defect, this invention is to provide an improved structure of long lifetime tact switch without increasing production cost.

SUMMARY OF THE INVENTION

This invention is characterized in applying plastic and rubber material cooperatively in a tact switch instead of a conventional in order to prolong lifetime of the tact switch under same cost.

For achieving abovesaid purpose, the tact switch of this invention comprises a seat body, a first elastic element, a press set, and a closure body. After the first elastic element and the press have been assembled and disposed in the seat body, the closure body is then combined on the seat body. When an external force is exerted on the press set, the press set will drive the first elastic element to contact and conductively joint with a first and a second electrode.

For a better understanding to the present invention, together with further advantages or features thereof, at least one preferred embodiment will be elucidated below with reference to the annexed drawings.

DETAILED DESCRIPTION OF THE PREFERRED EMBODIMENT

Figure 1:
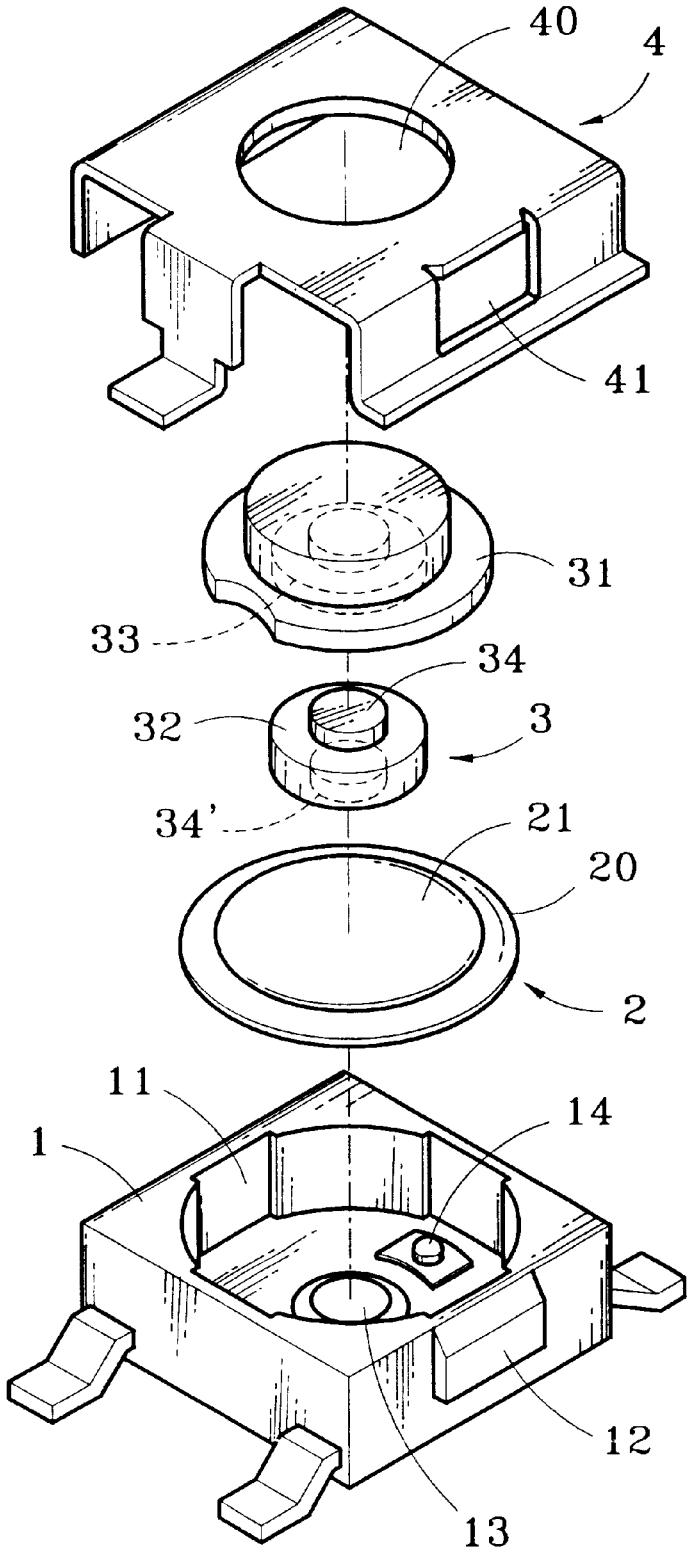
FIG. 1 is a schematic view showing a first embodiment of this invention.

As shown in FIG. 1 a schematic view showing a first embodiment of this invention an improved structure of tact switch of this invention comprises a seat body 1, a first elastic element 2, a press set 3, and a closure body 4.

The seat body 1 made of an insulating material is formed therein with an accommodating section 11 having a first conductive electrode 13 and a pair of second conductive electrodes 14 inside. An assemble-to-joint part 12 is disposed on each of two lateral faces of the seat body 1 externally for assembly-jointing the closure body 4.

The first elastic element 2 made of a pan-like metallic material is bulged from its rim 20 toward its central portion stepwise to form a bulge part 21, wherein the rim 20 is laid on the second conductive electrodes 14 while the bulge part 21 is located right over the first conductive electrode 13 with a narrow gap reserved in between. Therefore, when the first elastic element 2 is pressed downwards, the bottom face of the bulge part 21 will be forced to contact with the first conductive electrode 13 to enter a conductive state, and on the contrary, the first elastic element 2 will restore to its normal state due to a restoring force of its own.

The press set 3 that is disposed on the first elastic element 2 comprises a hat body 31 and a second elastic element 32, wherein a deposit part 33 is arranged in the hat body for storing the second elastic element 32 which is made of an elastic plastic or rubber material; a protruded part 34, 34' is formed on the top and the bottom face of the elastic element 32 respectively; and the protruded part 34' rests on the bulge part 21 of the first elastic element 2.

The closure body 4 is assembled and jointed with the seat body 1 at its top face, wherein a through hole 40 is formed in center position of the closure body 4 for exposing an upper rim of the hat body 31; a coupling part 41 is arranged in each of two lateral faces of the closure body 4 for assembling and jointing with each assemble-to-joint part 12 in order to position the press set 3 and the first elastic element 2 in the seat body 1 to complete a brand-new tact switch.

Figure 2:
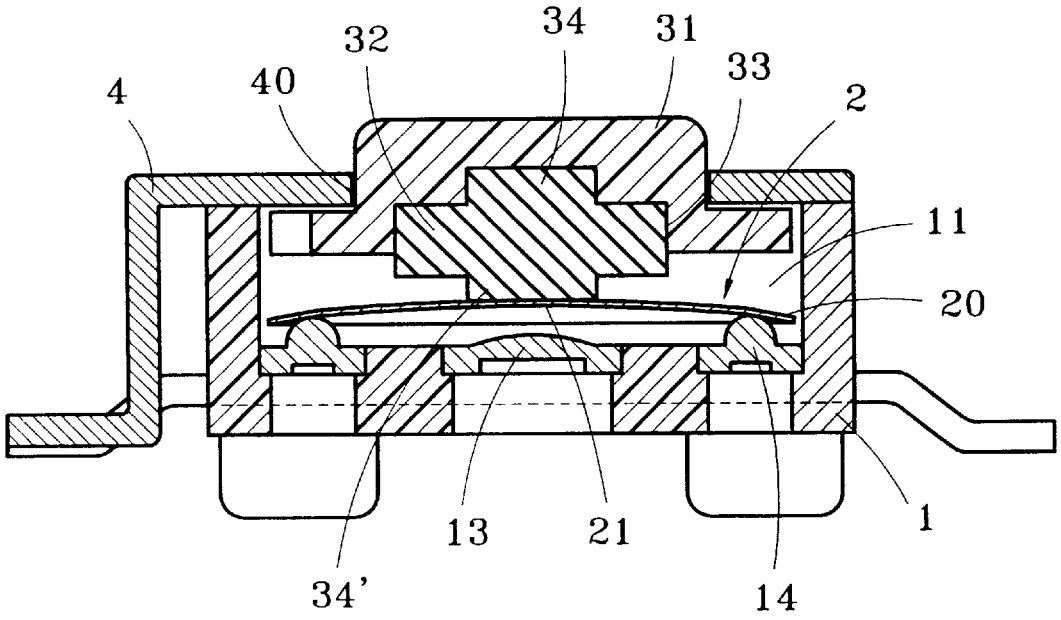
FIG. 2 is a cutaway sectional view of FIG. 1.

Referring to FIG. 2 a cutaway sectional view of this invention the assembly procedure is firstly to place the first elastic element 2 in the accommodating section 11 of the seat body 1 and meanwhile let the rim 20 of the first elastic element 2 lay on the second conductive electrodes 14, wherein the bulge part 21 is located right above the first elastic element 2 with a narrow gap reserved in between. Then, put the press set 3 on the first elastic element 2, joint the closure body 4 to the seat body 1 externally by coupling the coupling parts 41 of the closure body 4 with the assemble-to-joint parts 12 of the seat body 1. As soon as the hat body 31 of the press set 3 is pressed down by an external force, the hat body 31 will drive the second elastic element 32 to in turn press the bulge part 21 of the first elastic element 2 so that the bottom face of the bulge part 21 is forced to contact the first conductive electrode 13 to make connection between the first conductive electrode 13 and the second conductive electrodes 14. And no sooner has the external force been removed, than the first elastic element 2 restores by its own elastic force, and accordingly the press set 3 bounces back to its normal state.

Figure 3:
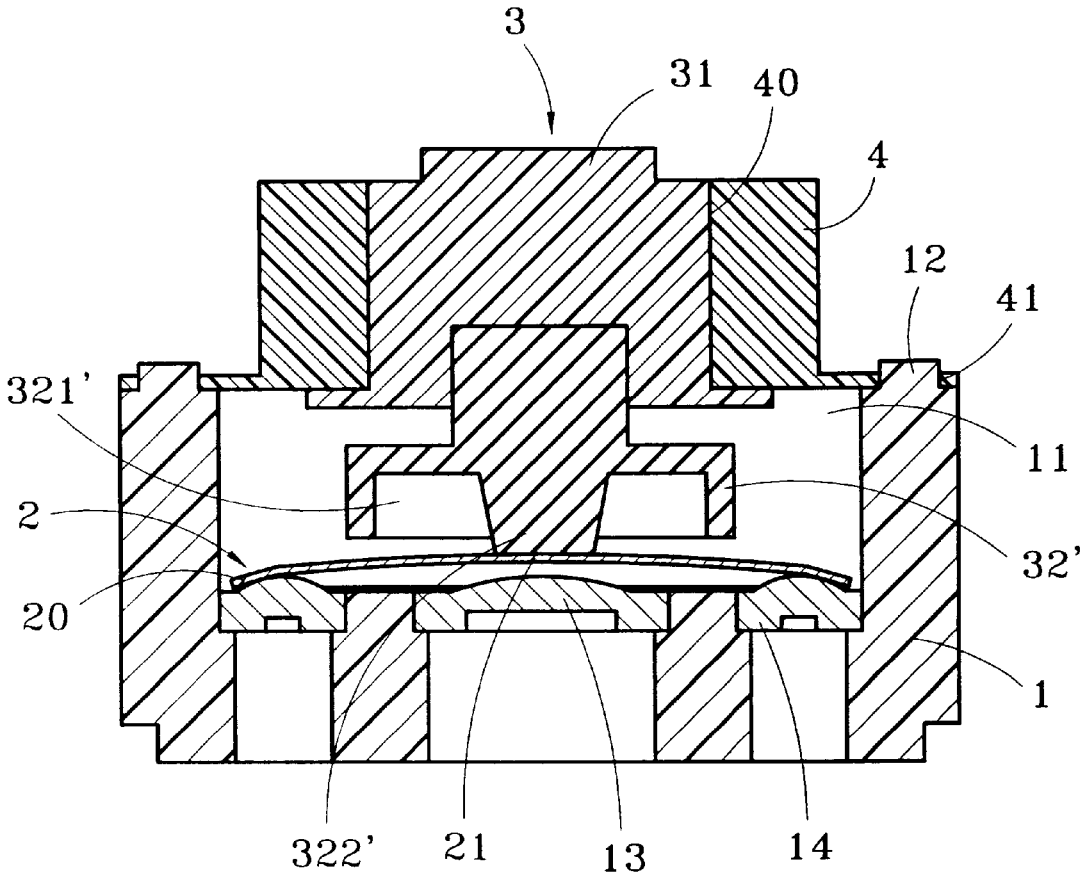
FIG. 3 is a schematic view showing a second embodiment of this invention.

In FIG. 3 a schematic view showing a second embodiment of this invention a recess 321' formed in the second elastic element 32' is provided with a protruded block 322' to facilitate the second elastic element 32' for being pressed downwards easily to thereby push the first elastic element 2 to conductively joint the first conductive electrode 13 and the second conductive electrodes 14 when the hat body 31 is pressed down by an external force.

Figure 4:
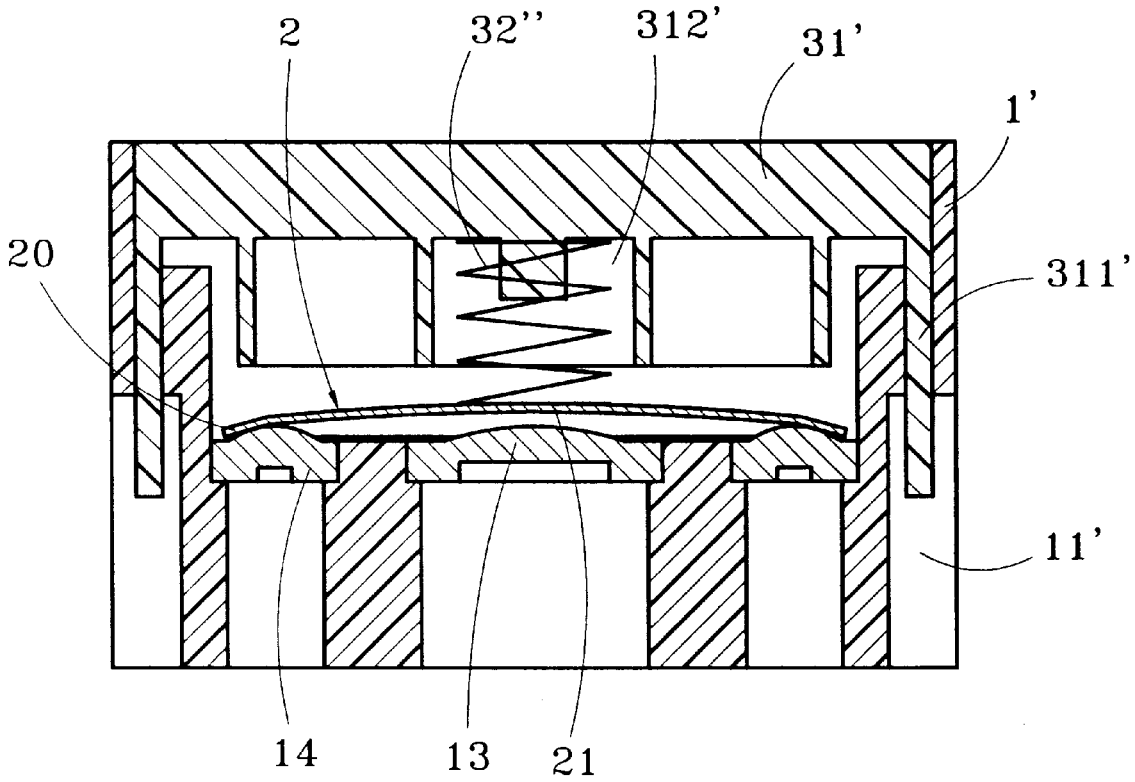
FIG. 4 is a schematic view showing a third embodiment of this invention.

As shown in FIG. 4, a third embodiment of this invention substitutes a closure body 31' of a tact switch for the hat body 31, wherein a plurality of buckling portions 311' is formed in the circumference of the closure body 31' for being pivotally fastened to a plurality of retaining holes 11' in the inside circumference of the seat body 1'; the second elastic element 32" is a spring body female-jointed in a storage portion 312' of the closure body 31'. When the closure body 31' is pressed down by an external force, it will squeeze the second elastic element 32" to in turn push the first elastic element 2 for conductively connecting the first conductive electrode 13 and the second conductive electrodes 14.

Moreover, the rubber-made second elastic element of the press set 3 will touch the first elastic element 2 softly to maintain its best press-durability while the plastics-made hat body 31 can keep its surface flush and smooth without wearing.

In the above described, at least one preferred embodiment has been elucidated with reference to drawings annexed, it is apparent that numerous variations or modifications may be made without departing from the true spirit and scope thereof, as set forth in the following claims.

What is claimed is:

1. An improved structure of tact switch, comprising:

a seat body having an assemble-to-joint part arranged on each of two lateral faces externally and an accommodating section which is provided with a first conductive electrode and a pair of second conductive electrodes;

a first elastic element disposed in said accommodating section;

a press set disposed in said accommodating section and located right above said first elastic element, the press set including a hat body and a second elastic element; and a closure body assembled and jointed onto said seat body, wherein a through hole is formed in said closure body to allow exposure of an upper rim of said press set; and a coupling part is disposed on each of two lateral faces of said closure body for assembling and jointing with each said assemble-to-joint part; whereby by means of said above construction, said press set being capable of pressing said first elastic element to make connection between said first conductive electrode and said second conductive electrodes when said press set is pressed down by an external force.

2. The improved structure of tact switch of claim 1, wherein a deposit part is formed in said hat body for storing said second elastic element, which second elastic element is made of a plastic or rubber material and is provided with a protruded part on each of its top and bottom faces.

3. The improved structure of tact switch of claim 1, wherein a recess having a protruded block is made in said second elastic element, said recess for facilitating said second elastic element to be pressed downwards easily when said hat body is pressed down by an external force.

* * * * *